US012637916B2

(12) United States Patent
Dietz et al.

(10) Patent No.: US 12,637,916 B2
(45) **Date of Patent: *May 26, 2026**

(54) DEBRIS RESISTANT KEYED RUNNING TOOL AND METHOD

(71) Applicant: Halliburton Energy Services, Inc., Houston, TX (US)

(72) Inventors: Wesley P. Dietz, Carrollton, TX (US); David Joe Steele, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/970,405

(22) Filed: Dec. 5, 2024

(65) Prior Publication Data

US 2025/0092748 A1 Mar. 20, 2025

Related U.S. Application Data

(63) Continuation of application No. 17/523,533, filed on Nov. 10, 2021, now Pat. No. 12,180,795.

(51) Int. Cl.
*E21B 23/03* (2006.01)
*E21B 7/06* (2006.01)

(52) U.S. Cl.
CPC ..... *E21B 23/03* (2013.01); *E21B 7/061* (2013.01)

(58) Field of Classification Search
CPC ..... E21B 23/00; E21B 23/03; E21B 7/061
See application file for complete search history.

(56) References Cited

U.S. PATENT DOCUMENTS

| | | | | |
|---|---|---|---|---|
| 2,887,162 | A | 5/1959 | Le Bus, Sr. | |
| 4,033,409 | A | 7/1977 | Hebert | |
| 5,474,131 | A | 12/1995 | Jordan, Jr. et al. | |
| 5,477,923 | A | 12/1995 | Jordan, Jr. et al. | |
| 5,566,763 | A | 10/1996 | Williamson et al. | |
| 6,012,527 | A * | 1/2000 | Nitis | E21B 29/06 166/50 |
| 6,019,173 | A | 2/2000 | Saurer et al. | |
| 6,305,474 | B1 | 10/2001 | Roberts et al. | |
| 8,678,097 | B1 * | 3/2014 | Telfer | E21B 23/12 166/85.1 |
| 9,140,081 | B2 | 9/2015 | Telfer et al. | |
| 9,394,763 | B2 | 7/2016 | Wolf et al. | |
| 2009/0107727 | A1 * | 4/2009 | Persson | E21B 19/16 175/57 |

(Continued)

FOREIGN PATENT DOCUMENTS

| | | | |
|---|---|---|---|
| EP | 0834643 | A2 | 4/1998 |
| EP | 1040250 | B1 | 3/2005 |

(Continued)

*Primary Examiner* — Nicole Coy
*Assistant Examiner* — Nicholas D Wlodarski
(74) *Attorney, Agent, or Firm* — Scott Richardson; Parker Justiss, P.C.

(57) ABSTRACT

Provided is a keyed running tool for use with a slotted orientation apparatus. The keyed running tool, in one aspect, includes a housing, and two or more keys extending from the housing, the two or more keys movable between a radially retracted state and a radially extended state, wherein adjacent ones of the two or more keys are laterally offset from each other and radially offset from each other by Y degrees, wherein Y is 180 degrees or less.

27 Claims, 18 Drawing Sheets

(56) References Cited

U.S. PATENT DOCUMENTS

| | | | | |
|---|---|---|---|---|
| 2011/0272165 | A1 | 11/2011 | Zierolf | |
| 2015/0259990 | A1 | 9/2015 | June | |
| 2015/0259995 | A1* | 9/2015 | Wolf | E21B 23/02 166/241.1 |
| 2018/0087335 | A1* | 3/2018 | Weckend | E21B 47/09 |
| 2018/0252075 | A1* | 9/2018 | Dietz | E21B 41/0035 |
| 2018/0340377 | A1* | 11/2018 | Eggers | E21B 17/046 |
| 2019/0120008 | A1 | 4/2019 | DeBerry et al. | |

FOREIGN PATENT DOCUMENTS

| | | | |
|---|---|---|---|
| WO | 9719249 | A1 | 5/1997 |
| WO | 2019094043 | A1 | 5/2019 |

* cited by examiner

If $\theta_{Rep} = 15°$, Then $X < 150°$
If $\theta_{Rep} = 30°$, Then $X < 120°$
If $\theta_{Rep} = 40°$, Then $X < 100°$
If $\theta_{Rep} = 45°$, Then $X < 90°$
If $\theta_{Rep} = 60°$, Then $X < 60°$

DEBRIS RESISTANT KEYED RUNNING TOOL AND METHOD

CROSS-REFERENCE TO RELATED APPLICATION

This application is a continuation of U.S. patent application Ser. No. 17/523,533, filed on Nov. 10, 2021, entitled "DEBRIS RESISTANT KEYED RUNNING TOOL AND METHOD". The above-listed application IS commonly assigned with the present application is incorporated herein by reference as if reproduced herein in its entirety.

BACKGROUND

A variety of borehole operations require selective access to specific areas of the wellbore. One such selective borehole operation is horizontal multistage hydraulic stimulation, as well as multistage hydraulic fracturing ("frac" or "fracking"). In multilateral wells, the multistage stimulation treatments are performed inside multiple lateral wellbores. Efficient access to all lateral wellbores is critical to complete a successful pressure stimulation treatment, as well as is critical to selectively enter the multiple lateral wellbores with other downhole devices.

BRIEF DESCRIPTION

Reference is now made to the following descriptions taken in conjunction with the accompanying drawings, in which.

DETAILED DESCRIPTION

Figure 1:
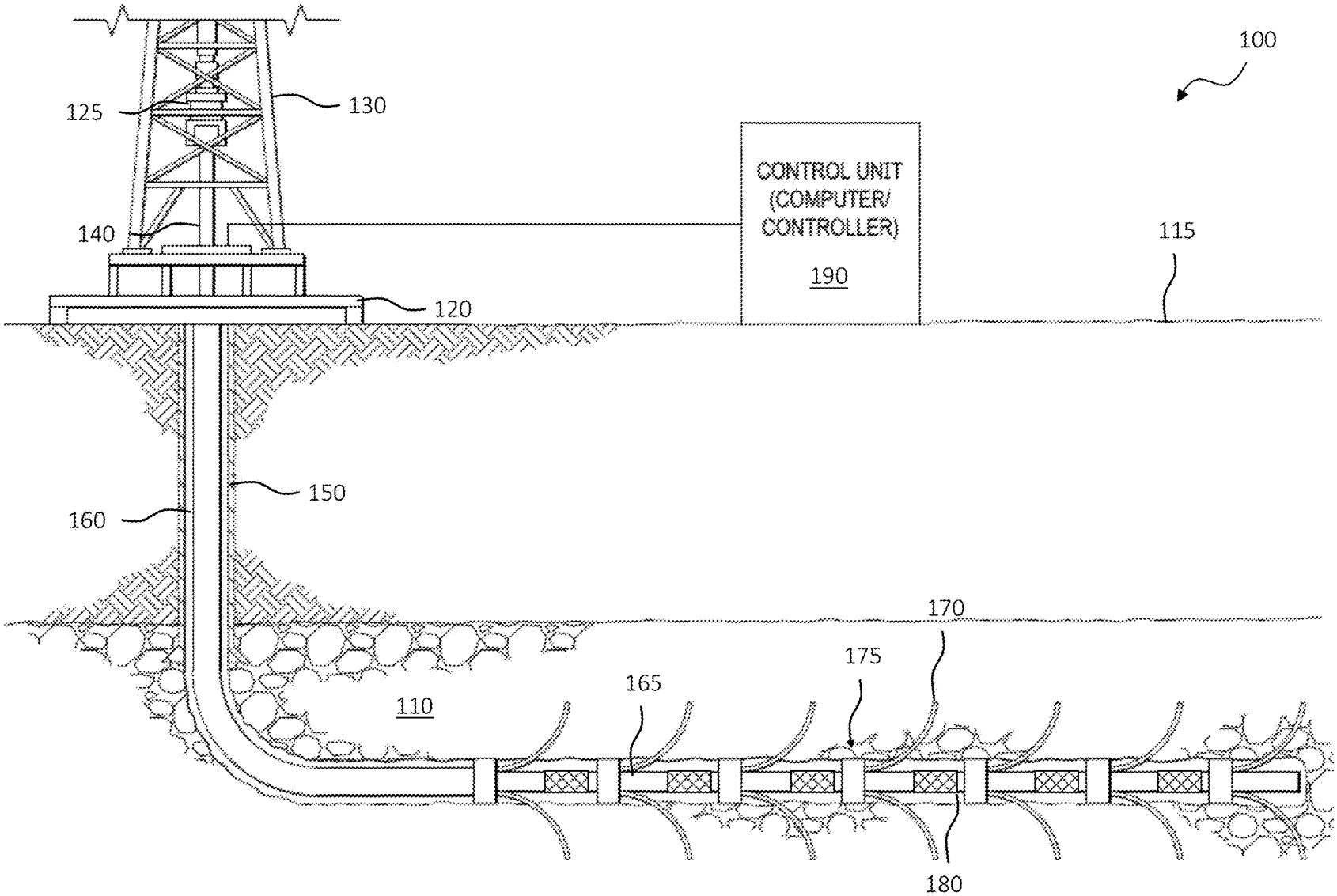
FIG. 1 illustrates a well system designed, manufactured, and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include an indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure acknowledges that there are certain instances, particularly during stimulation and/or fracturing operations, where it may be desirable to employ a slotted orientation apparatus (e.g., also known in the art as a slotted muleshoe) to position a downhole tool within a wellbore. The present disclosure, based upon this acknowledgment, has recognized that debris, such as frac sand in one embodiment, may collect within the slot in the slotted orientation apparatus and present problems with a key of an associated keyed running tool sliding within the slot. With this in mind, the present disclosure has in one embodiment designed a slotted orientation apparatus with the placement of the slot on a high side of the tubular (e.g., such that no portion of the slot is located below 3 o'clock or below 9 o'clock relative to gravity), which greatly reduces this problem. For example, such an embodiment could employ a slot that radially extends around the tubular 180 degrees or less, and in one embodiment a slot that has its radial centerpoint positioned at 12 o'clock relative to gravity. In accordance with at least one embodiment, an orientation tool could be coupled to the slotted orientation apparatus, the orientation tool configured to orient the slot of the slotted orientation apparatus within the wellbore (e.g., on the high side of the tubular). In yet another embodiment the orientation tool is a measurement while drilling (MWD) tool that uses pressure pulses to orient the slot of the slotted orientation apparatus within the wellbore.

The present disclosure has additionally acknowledged that it can, at times, be difficult to align the keys of the keyed running tool with the slot in the slotted orientation apparatus. The present disclosure has recognized that such can especially be the case when the slot in the slotted orientation apparatus does not extend entirely around the tubular, such as is the case with the aforementioned slotted orientation apparatus with the placement of the slot on the high side of the tubular. With this acknowledgment in mind, the present disclosure designed a keyed running tool having two or more keys movable between a radially retracted state and a radially extended state, wherein adjacent ones of the two or more keys are laterally offset from each other and radially offset from each other by Y degrees, wherein Y is 180 degrees or less. Given this design, ideally at least one of the two keys would engage with the slot when the keyed running tool is being deployed downhole.

FIG. 1 illustrates a well system 100 designed, manufactured, and operated according to one or more embodiments of the disclosure. The well system 100 includes a platform 120 positioned over a subterranean formation 110 located below the earth's surface 115. The platform 120, in at least one embodiment, has a hoisting apparatus 125 and a derrick 130 for raising and lowering a downhole conveyance 140, such as a drill string, casing string, tubing string, coiled tubing, a running tool, etc. Although a land-based oil and gas platform 120 is illustrated in FIG. 1, the scope of this disclosure is not thereby limited, and thus could potentially apply to offshore applications. The teachings of this disclosure may also be applied to other land-based multilateral wells different from that illustrated.

The well system 100, in one or more embodiments, further includes a main wellbore 150. The main wellbore 150, in the illustrated embodiment, includes tubing 160, 165, which may have differing tubular diameters. Extending from the main wellbore 150, in one or more embodiments, may be one or more lateral wellbores 170. Furthermore, a plurality of multilateral junctions 175 may be positioned at junctions between the main wellbore 150 and the lateral wellbores 170. The multilateral junctions 175 may be designed, manufactured and operated according to one or more embodiments of the disclosure. In accordance with at least one embodiment, the multilateral junction 175 may include a slotted orientation apparatus and/or keyed running tool according to any of the embodiments, aspects, applications, variations, designs, etc. disclosed in the following paragraphs.

The well system 100 may additionally include one or more ICVs 180 positioned at various locations within the main wellbore 150 and/or one or more of the lateral wellbores 170. The well system 100 may additionally include a control unit 190. The control unit 190, in this embodiment, is operable to provide control to or received signals from, one or more downhole devices.

Figure 2:
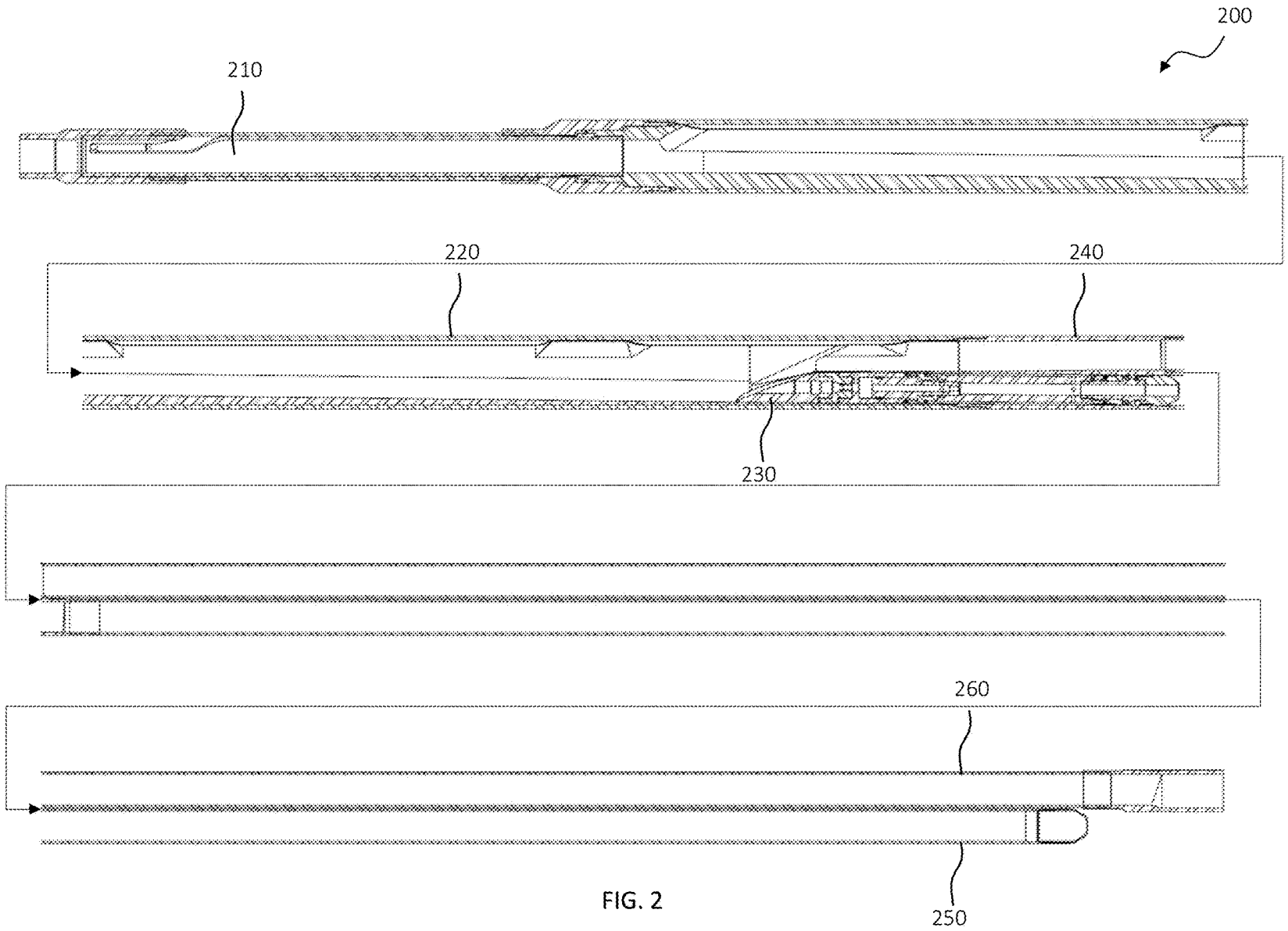
FIG. 2 illustrates one embodiment of a multilateral junction designed, manufactured and/or operated according to one or more embodiments of the disclosure.

Turning to FIG. 2, illustrated is one embodiment of a multilateral junction 200 designed, manufactured and/or operated according to one or more embodiments of the disclosure. The multilateral junction 200, in the illustrated embodiment, includes a slotted orientation apparatus 210. In at least one embodiment, the slotted orientation apparatus 210 includes a tubular having a wall thickness (t). The slotted orientation apparatus 210, in at least one other embodiment, additionally includes a slot extending at least partially through the tubular, the slot having first and second axial portions laterally offset from one another by a distance ($d_s$), and an angled portion connecting the first and second axial portions, wherein the slot radially extends around the tubular X degrees, wherein X is 180 degrees or less. In one or more embodiments, the slot extends entirely through the wall thickness (t) of the slotted orientation apparatus 210, but in other embodiments the slot only extends into an inner surface of the slotted orientation apparatus 210 (e.g., only partially through the wall).

The multilateral junction 200, in the illustrated embodiment, additionally includes a tubular spacer 220 positioned downhole of the slotted orientation apparatus 210, a whipstock 230 positioned downhole of the tubular spacer 220, and a y-block 240 positioned downhole of the whipstock 230. In the embodiment of FIG. 2, the multilateral junction 200 additionally includes a main bore leg 250 and a lateral bore leg 260 coupled to a downhole end of the y-block.

A keyed running tool (not shown) could be used to position (e.g., rotationally position) one or more features within the multilateral junction 200. For example, the key(s) of the keyed running tool could slide within the slot of the slotted orientation apparatus 210 to position the one or more features within the multilateral junction 200. In at least one embodiment, the keyed running tool is configured to position the whipstock 240 (e.g., a tubing exit whipstock "TEW") at a desired lateral and rotational position within the multilateral junction 200. Notwithstanding the foregoing, the slotted orientation apparatus 210 could be used to positioned different features within the multilateral junction 200, or alternatively could be used to positioned different features not associated with the multilateral junction 200.

Figure 3A:
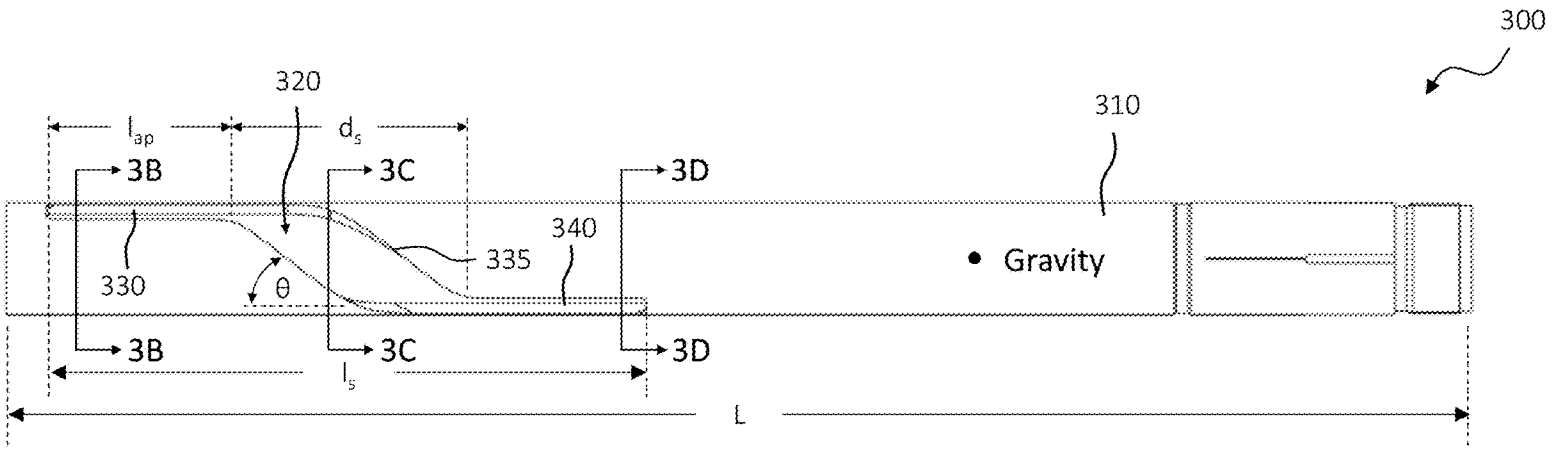
FIGS. 3A through 3H illustrate various different views of a slotted orientation apparatus designed, manufactured, and operated according to one or more embodiments of the disclosure.
Figure 3B:
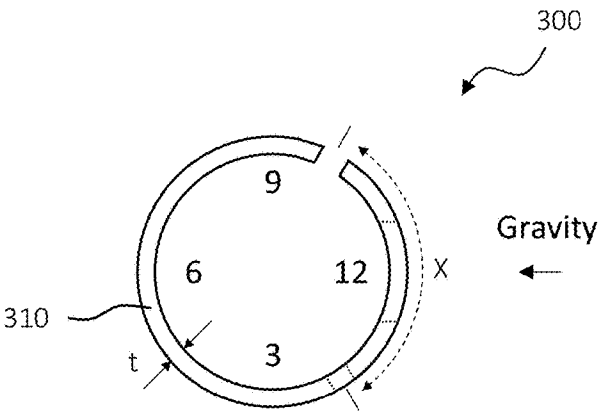
Figure 3C:
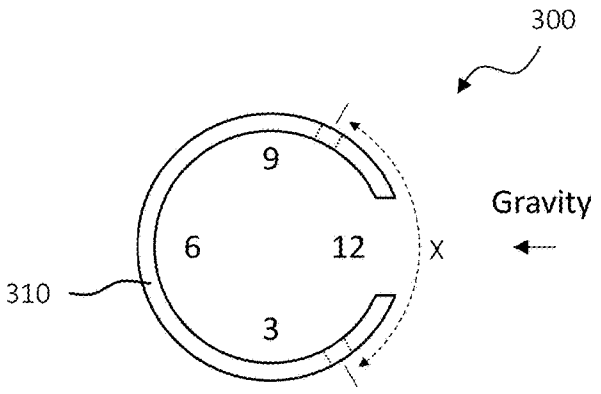
Figure 3D:
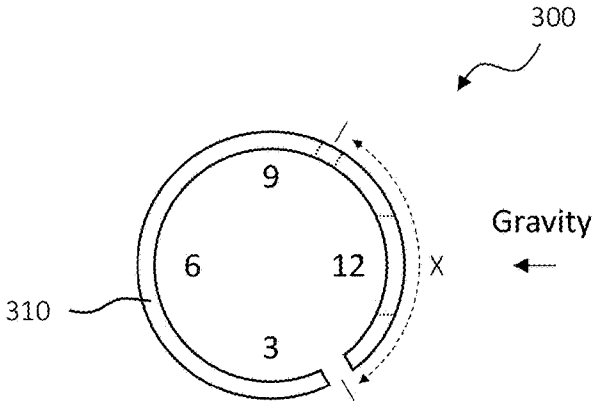
Figure 3E:
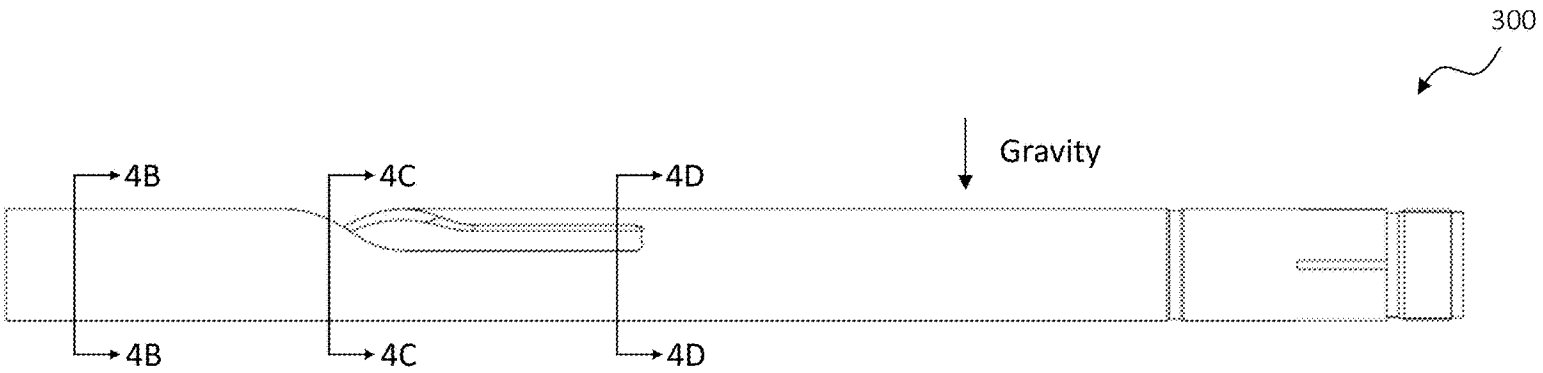
Figure 3F:
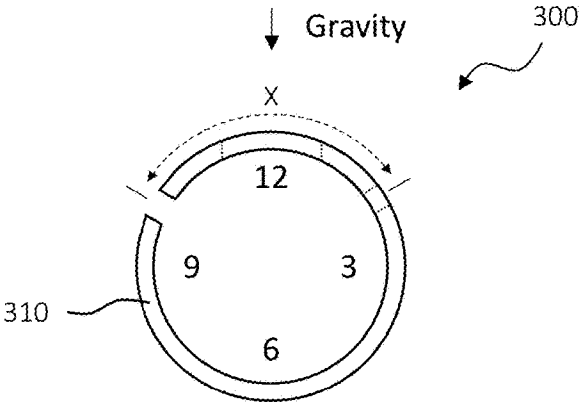
Figure 3G:
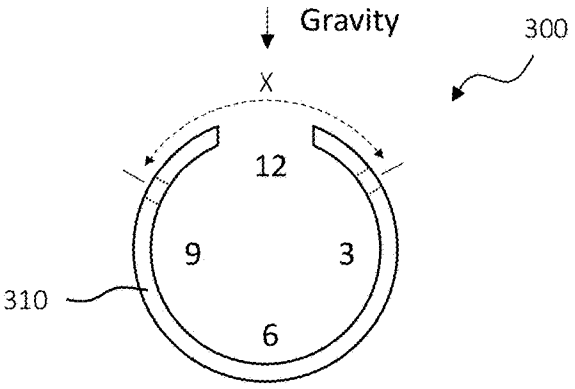
Figure 3H:
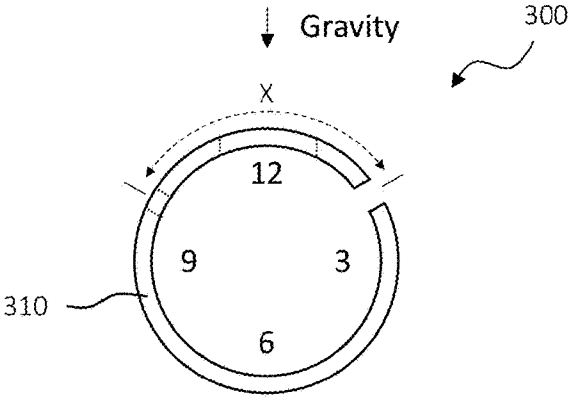

Turning to FIGS. 3A through 3H, illustrated are various different views of a slotted orientation apparatus 300 designed, manufactured, and operated according to one or more embodiments of the disclosure. FIG. 3A illustrates a top-down view of the slotted orientation apparatus 300, whereas FIGS. 3B through 3D illustrate various different sectional views of the slotted orientation apparatus 300 taken through the top-down view of FIG. 3A. In contrast, FIG. 3E illustrates a right-side view of the slotted orientation apparatus 300, whereas FIGS. 3F through 3H illustrate various different sectional views of the slotted orientation apparatus 300 taken through the right-side view of FIG. 3E. Each of the views illustrated in FIGS. 3A through 3H additionally illustrate clock settings, as would relate to the illustrated point of gravity. The slotted orientation apparatus 300, in at least one embodiment, is configured for use with a keyed running tool, such as that discussed below, and may be positioned within another tubular, such as casing.

The slotted orientation apparatus 300, in the embodiment illustrated in FIGS. 3A through 3H, includes a tubular 310 having a wall thickness (t). Many different tubular materials, and wall thicknesses (t), may be used for the tubular 310 and remain within the scope of the disclosure. Nevertheless, in at least one embodiment, the tubular 310 is a steel tubular, and the wall thickness (t) ranges from 0.07 cm to 5 cm. Furthermore, in at least one embodiment, the tubular could have a length (l) ranging from 5 cm to 18.5 m.

In accordance with at least one other embodiment of the disclosure, the slotted orientation apparatus 300 includes a slot 320 extending through the tubular 310. In one or more embodiments, the slot 320 has first and second axial portions 330, 340 laterally offset from one another by a distance ($d_s$), and an angled portion 335 connecting the first and second axial portions 330. 340. The slot 320, in at least one embodiment, radially extends around the tubular 310 by X degrees, wherein X is 180 degrees or less. In at least one other embodiment, X is less than 180 degrees. In yet another embodiment, such as shown in FIGS. 3A through 3H, X is 120 degrees or less, and in one embodiment 120 degrees. In even yet another embodiment, X is 90 degrees or less. As will be discussed in greater detail below, the actual degrees for X may relate to the number of keys employed in the keyed running tool. For example, if three equally spaced keys are used, X would equal 120 degrees. If four equally spaced keys were used, X would equal 90 degrees. If five equally spaced keys were used, X would equal 72 degrees.

The angle X may also be based upon the coefficient of friction between the material within the tubular 310 (e.g., frac sand, coated frac proppant, formation fines, etc.) and the angled surfaces of the slot 320, as well as the angle of repose of the material within the tubular 310. For example, in at least one embodiment, frac sand is being deployed down the tubular 310. Accordingly, the frac sand might have an angle of repose of Z degrees (e.g., wet sand has an angle of repose of 45 degrees), and the angle X might be chosen based upon the aforementioned coefficient of friction and the angle of repose of Z degrees (e.g., say for example 45 degrees). Thus, the combination of the coefficient of friction between the frac sand and the lower ledge of the slot 320, along with the angle of repose of Z degrees, would cause the frac sand to not collect on the angled surfaces of the slot 320.

Figure 3I:
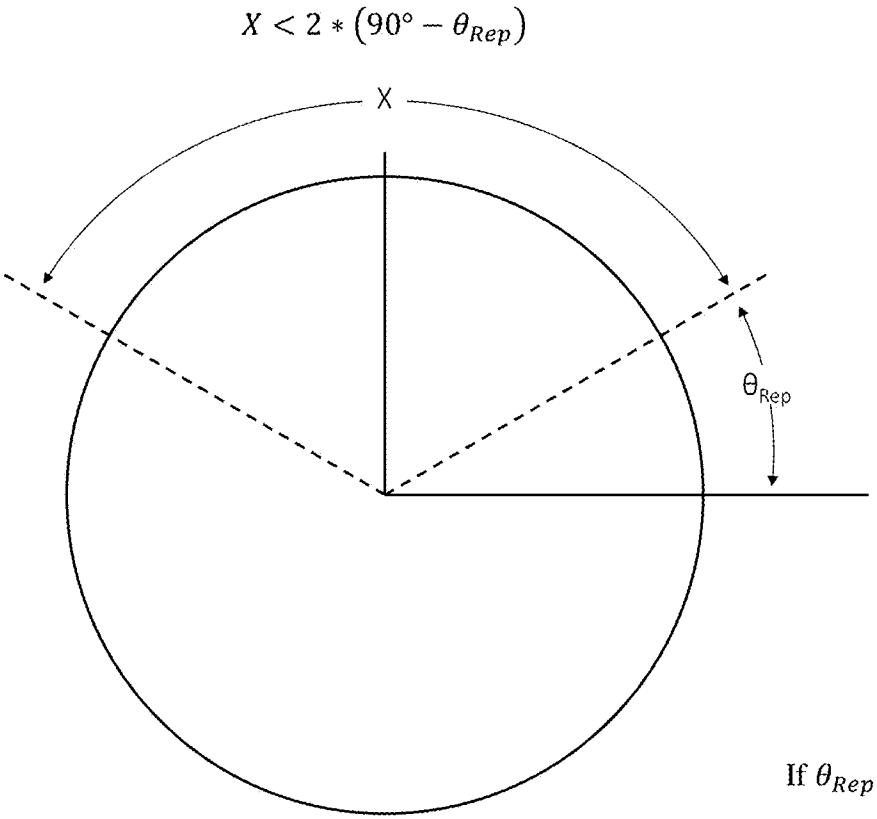
FIG. 3I illustrates an example of employing the angle of repose of a material in the tubular to calculate the angle X.

As an example, the angle X might be less than twice a complementary angle of repose of the material within the tubular 310 (e.g., X<2* (90°-angle of repose of material, or θRep)) when a radial centerpoint of the slot 320 is positioned at 12 o'clock relative to gravity, as shown in FIG. 3I. In one embodiment, the material might have an angle of repose (θRep) of at least 15 degrees (e.g., water filled sand), and the angle X would be less than 150 degrees (e.g., X<2* (90°-15°)). In another embodiment, the material might have an angle of repose (θRep) of at least 30 degrees (e.g., water filled sand), and the angle X would be less than 120 degrees (e.g., X<2* (90°-30°)). In yet another embodiment, the material might have an angle of repose (θRep) of at least 40 degrees, and the angle X would be less than 100 degrees (e.g., X<2* (90°-40°)). In yet another embodiment, the material might have an angle of repose (θRep) of at least 45 degrees, and the angle X would be less than 90 degrees (e.g., X<2* (90°-45°)).

The slot 320, in certain embodiments, is located on a high side of the tubular 310 such that no portion of the slot 320 is located below 3 o'clock or below 9 o'clock relative to gravity. In such embodiments, X would need to be less than 180 degrees to accommodate a width of the first and second axial portions 330, 340. For example, depending on the width of the first and second axial portions 330, 340, X might need to be 175 degrees or less to accommodate the aforementioned high side. In certain other embodiments, such as that shown in FIGS. 3A through 3H, a radial centerpoint of the slot 320 is positioned at 12 o'clock relative to gravity.

Further to the embodiment of FIGS. 3A through 3H, the slot 320 may have a length ($l_s$), and the first and second axial portions may have a length ($l_{ap}$). Thus, in accordance with one or more embodiments, the length ($l_s$) ranges from 2.5 cm to 900 cm and the length ($l_{ap}$) ranges from 1 cm to 600 cm. Similarly, in an embodiment, the distance ($d_s$) ranges from 1 cm to 900 cm, among others. Given certain dimensions of the slot 320, an angle (θ) of the angled portion 335 may range from 15 degrees to 60 degrees, and in yet another embodiment from 25 degrees to 50 degrees.

Figure 4A:
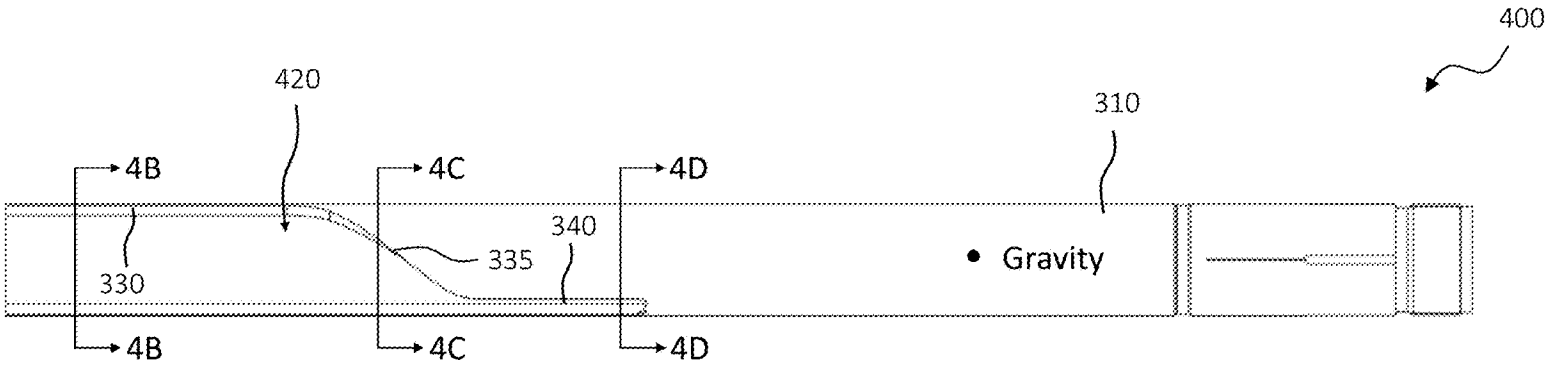
FIGS. 4A through 4D illustrate various different views of a slotted orientation apparatus designed, manufactured, and operated according to one or more alternative embodiments of the disclosure.
Figure 4B:
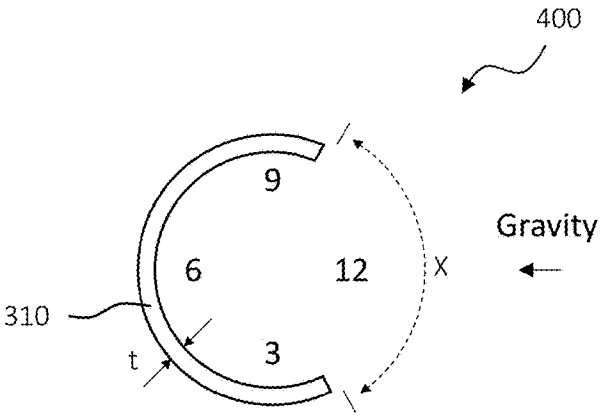
Figure 4C:
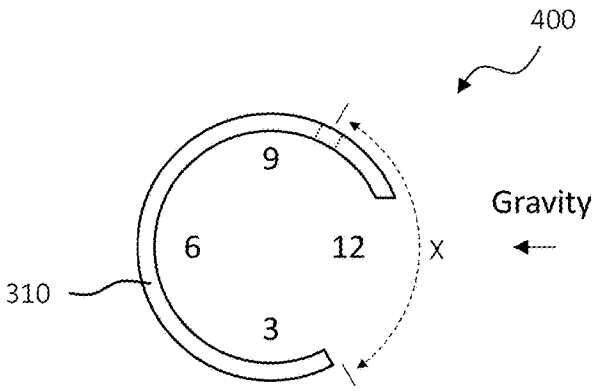
Figure 4D:
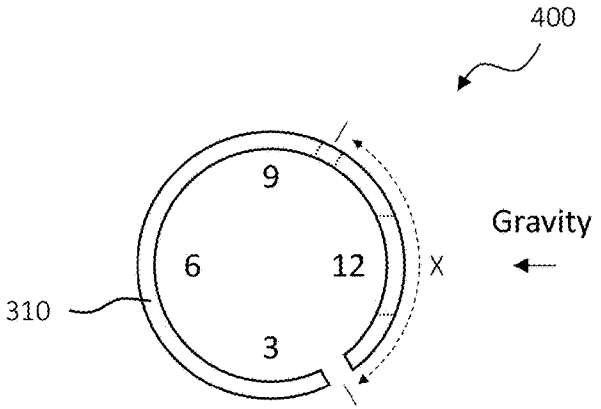

Turning to FIGS. 4A through 4D, illustrated are various different views of a slotted orientation apparatus 400 designed, manufactured, and operated according to one or more alternative embodiments of the disclosure. FIG. 4A illustrates a top-down view of the slotted orientation apparatus 400, whereas FIGS. 4B through 4D illustrate various different sectional views of the slotted orientation apparatus 400 taken through the top-down view of FIG. 4A. The slotted orientation apparatus 400 is similar in many respects to the slotted orientation apparatus 300. Accordingly, like reference numbers have been used to indicate similar, if not identical, features. For example, the slotted orientation apparatus 400 includes the first axial portion 330, the angled portion 335, and the second axial portion 340. Nevertheless, the slotted orientation apparatus 400 employs an open-type slot 420, as opposed to the more closed-type slot 320 of the slotted orientation apparatus 300.

Figure 5A:
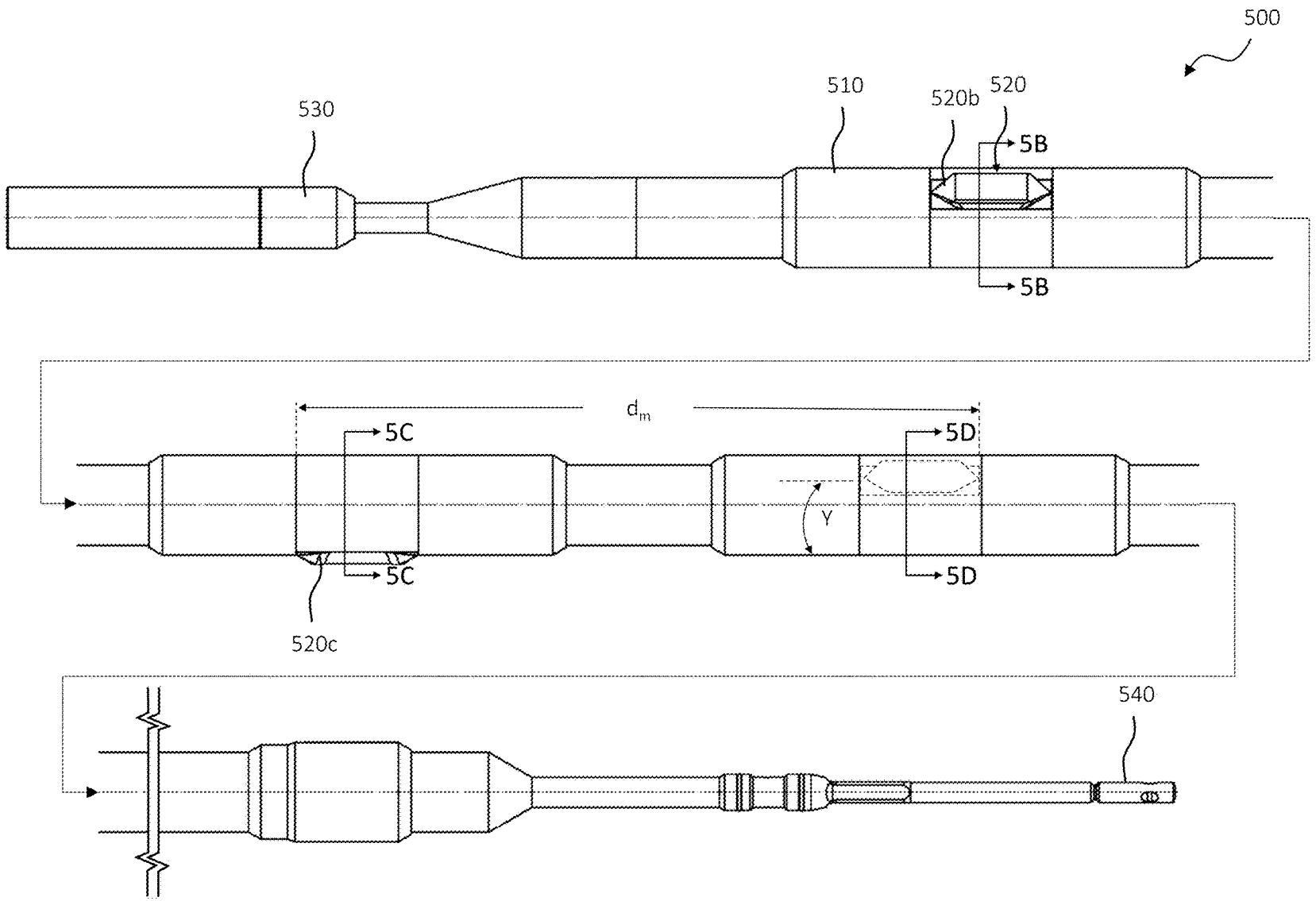
FIGS. 5A through 5D illustrate different views of a keyed running tool designed, manufactured and operated according to one or more embodiments of the disclosure.
Figure 5B:
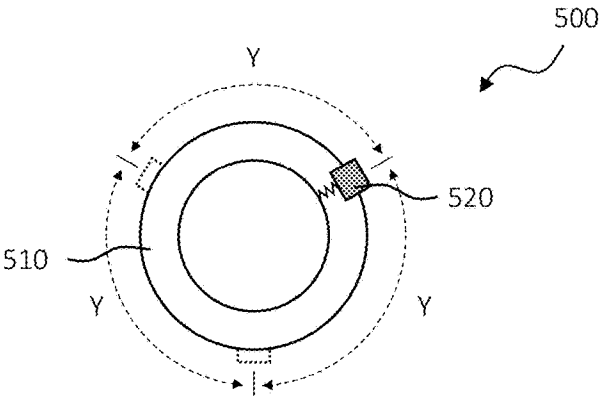
Figure 5C:
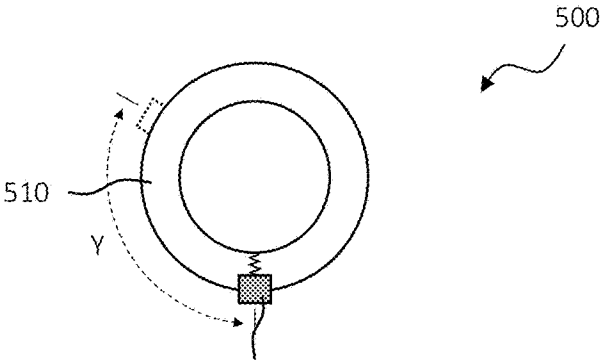
Figure 5D:
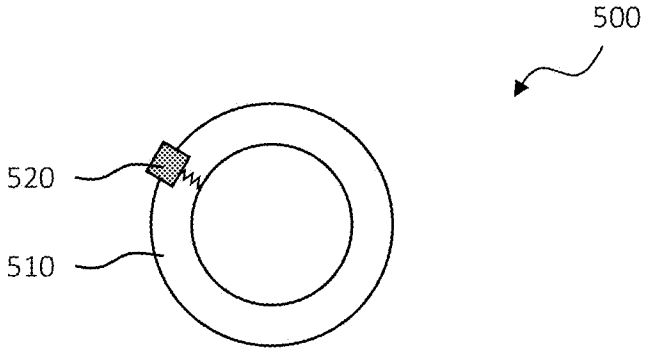

Turning to FIGS. 5A through 5D, illustrated are different views of a keyed running tool 500 designed, manufactured and operated according to one or more embodiments of the disclosure. FIG. 5A illustrates an isometric view of the keyed running tool 500, whereas FIGS. 5B through 5D illustrated cross-sectional views taken at various different locations of the keyed running tool 500. The keyed running tool 500, in at least one embodiment, is configured for use with a slotted orientation apparatus, such as the slotted orientation apparatus 300 illustrated above with regard to FIGS. 3A through 4D.

The keyed running tool 500 illustrated in FIGS. 5A through 5D, in one or more embodiments, includes a housing 510. The housing 510 may comprise many different shapes, lengths and/or materials while remaining within the scope of the disclosure. In at least one embodiment, however, the housing 510 comprises steel. Housing 510 may comprise more than one component in order to perform its function (securing the more than one key, alignment of the keys, attaching the main housing to tools at one or both ends.

The keyed running tool 500, in accordance with one embodiment of the disclosure, includes two or more keys 520 extending from the housing 510. The two or more keys 520, in certain embodiments, are movable between a radially retracted state (e.g., where they may be flush with an outside diameter of the housing 510) and a radially extended state (e.g., such as shown, where they extend beyond the outside diameter of the housing 510). For example, the two or more keys 520 may be two or more spring loaded keys 520, and remain within the scope of the disclosure. In the embodiment of FIGS. 5A through 5D, the keyed running tool 500 includes three keys 520.

In accordance with one embodiment of the disclosure, adjacent ones of the two or more keys 520 are radially offset from each other by Y degrees, wherein Y is 180 degrees or less. For example, depending on the number of keys 520, Y may vary. For example, if three equally spaced keys are used, Y would equal 120 degrees. If four equally spaced keys were used, Y would equal 90 degrees. If five equally spaced keys were used, Y would equal 72 degrees. In certain instances, it may be advantageous to have an odd number of equally spaced keys, such that no two keys are radially offset from one another by 180 degrees. In certain instances, it may be advantageous to have the three-or-more keys spaced at different angles from one another. For example, if the assembly that needs to be urged into a certain orientation, but its center of mass is not positioned along the centerline, then having two keys engaged at a particular orientation can distribute the stresses over a larger area to reduce the stresses upon the keys (and slots). Likewise, the keys may be made wider to increase the load-bearing area of the keys to reduce the stresses upon the keys and orientation slot.

In accordance with one embodiment of the disclosure, adjacent ones of the two or more keys 520 are laterally offset from each other. For example, adjacent ones of the two or more keys are laterally offset from each other by a maximum distance ($d_m$). In at least one embodiment, the maximum distance ($d_m$) ranges from 2.5 cm to 900 cm. Nevertheless, other values for the maximum distance ($d_m$) are within the scope of the disclosure. For example, in at least one embodiment (e.g., as shown) an uphole of the two or more keys 520 is a single first key 520*b* extending from the housing 510 at a first lateral location (e.g., cross-section 5B-5B), the single first key 520*b* movable between a first radially retracted state and a first radially extended state, and an other of the two or more keys is a single second key 520*c* extending from the housing 510 at a second different lateral location (e.g., cross-section 5C-5C), the single second key 520*c* movable between a second radially retracted state and a second radially extended state, wherein the single first key 520*b* and the single second key 520*c* are radially offset from each other by Y degrees, wherein Y is 180 degrees or less. Furthermore, in the illustrated embodiment, no keys of the two or more keys 520 extending from the housing 510 are rotationally aligned.

In certain embodiments, the value for the Y (e.g., the radial offset of the keys 520) and the value for X (e.g., how far the slot of the slotted orientation apparatus radially extends around the tubular) relate to one another. For example, certain embodiments exist wherein the value for Y is substantially equal to the value for X. The term "substantially equal," as used herein with respect to the associated values for Y and X, means that the values are within 10 percent of one another, for example to accommodate a width of the key 520. In other embodiments, the value for Y is ideally equal to the value for X. The term "ideally equal," as used herein with respect to the associated values for Y and X, means that the values are within 5 percent of one another, for example to accommodate a width of the key 520. In yet other embodiments, the value for Y is exactly equal to the value for X. The term "exactly equal," as used herein with respect to the associated values for Y and X, means that the values are within 1 percent of one another.

Similarly, in certain embodiments, the maximum distance ($d_m$) (e.g., the maximum lateral offset of adjacent key 520) and the length ($l_s$) of the slot of the slotted orientation apparatus relate to one another. For example, in certain embodiments it is beneficial for two or more of the keys 520 to reside within the slot at the same time. Accordingly, in at least one embodiment, the maximum distance ($d_m$) is less than the length ($l_s$). However, in certain other embodiments it is beneficial for the two or more keys 520 to reside within the first and second axial portions of the slot, respectively, thus the maximum distance ($d_m$) is greater than the distance ($d_s$) (e.g., the lateral distance between the first and second axial portions).

The keyed running tool 500, in one or more embodiments, may additionally include a swivel 530 coupled to an uphole end of the housing 510. In at least one embodiment, the swivel 530 is configured to allow the housing 510 and the two or more keys 520 to rotate when following a slot in a slotted orientation apparatus. The keyed running tool 500 may additionally include an engagement member 540 coupled to a downhole end of the housing 510. The engagement member 540, in at least on embodiment, is configured to engage with a downhole tool and rotationally position the downhole tool within a wellbore it is located within. For example, the engagement member 540 could engage with a whipstock, such as the whipstock 230 illustrated in FIG. 2, in which case the keyed running tool 500 would be used to rotationally position the whipstock 230 within the multilateral junction 200.

Turning now to FIGS. 6A through 6F, illustrated is one embodiment for aligning a downhole tool in accordance with the disclosure. For example, the embodiment for aligning a downhole tool could include employing a slotted orientation apparatus 600 and a keyed running tool 650 for aligning a downhole tool. In at least one embodiment, the slotted orientation apparatus 600 and the keyed running tool 650 are similar to the slotted orientation apparatus 300 and the keyed running tool 500 discussed above. Thus, in at least one embodiment, the slotted orientation apparatus 600 could include a tubular 610, as well as a slot 620 extending through the tubular, the slot having first and second axial portions 630, 640 laterally offset from one another by a distance ($d_s$), and an angled portion 635 connecting the first and second axial portions 630, 640. In accordance with at least one embodiment, the slot 620 radially extends around the tubular 610 X degrees, wherein X is 180 degrees or less. Similarly, in at least one embodiment, the keyed running tool 650 could include a housing 660, as well as two or more keys 670 extending from the housing 660, the two or more keys 670 movable between a radially retracted state and a radially extended state. In accordance with at least one embodiment, adjacent ones of the two or more keys 670 are laterally offset from each other and radially offset from each other by Y degrees, wherein Y is 180 degrees or less.

In the embodiment of FIGS. 6A through 6F, the slot 620 of the slotted orientation apparatus 600 radially extends around the tubular 610 by 120 degrees. Similarly, the keyed running tool 650 includes three keys, including a downhole key 670*a*, a middle key 670*b*, and an uphole key 670*c*. Further to the embodiment of FIGS. 6A through 6F, the downhole key 670*a*, middle key 670*b*, and uphole key 670*c* are radially offset from each other by 120 degrees. While a three key 670 and 120 degree design is being illustrated and described with regard to FIGS. 6A through 6F, other number of keys 670 and radial spacing are within the scope of the disclosure.

Figure 6A:
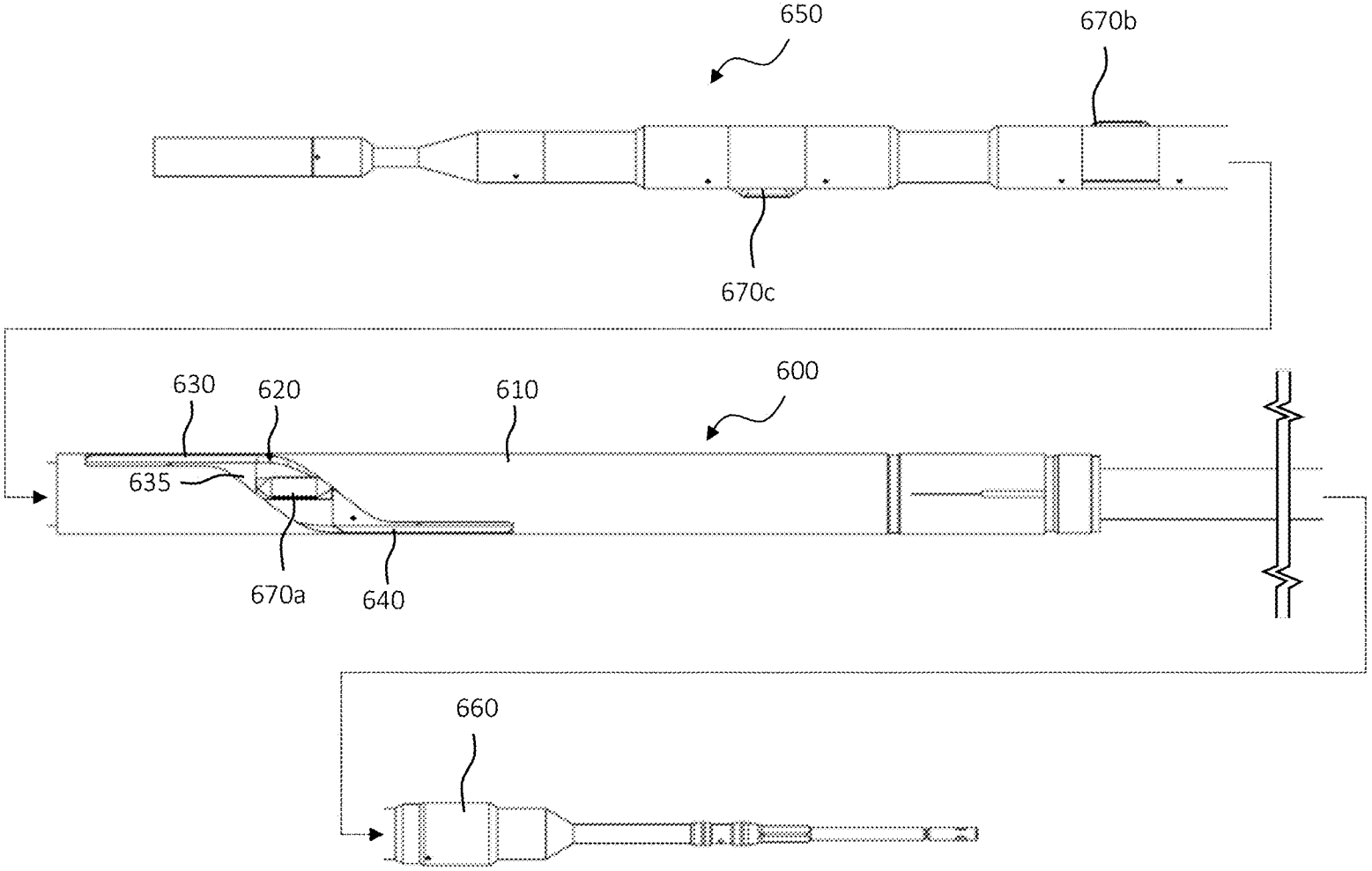
FIGS. 6A through 6F illustrate one embodiment for aligning a downhole tool in accordance with the disclosure.

With reference to FIG. 6A, the keyed running tool 650 is initially at least partially engaged with the slotted orientation apparatus 600. For example, in the embodiment of FIG. 6A, the downhole key 670*a* is laterally aligned with the slot 620 when the keyed running tool 650 is being pushed downhole. Thus, in the embodiment of FIG. 6A, the downhole key 670*a* may engage with the slot 620, as is shown. While FIG. 6A illustrates the downhole key 670*a* positioned in the angled portion 635 of the slot 620, depending on the initial radial alignment between the downhole key 670*a* and the slot 620, the downhole key 670*a* might alternatively initially engage the first axial portion 630 or initially engage the second axial portion 640. Additionally, as the keys 670 are movable between radially retracted states and radially extended states, a location at which the keys 670 engage with the slot 620 has no effect on the keys 670.

Figure 6B:
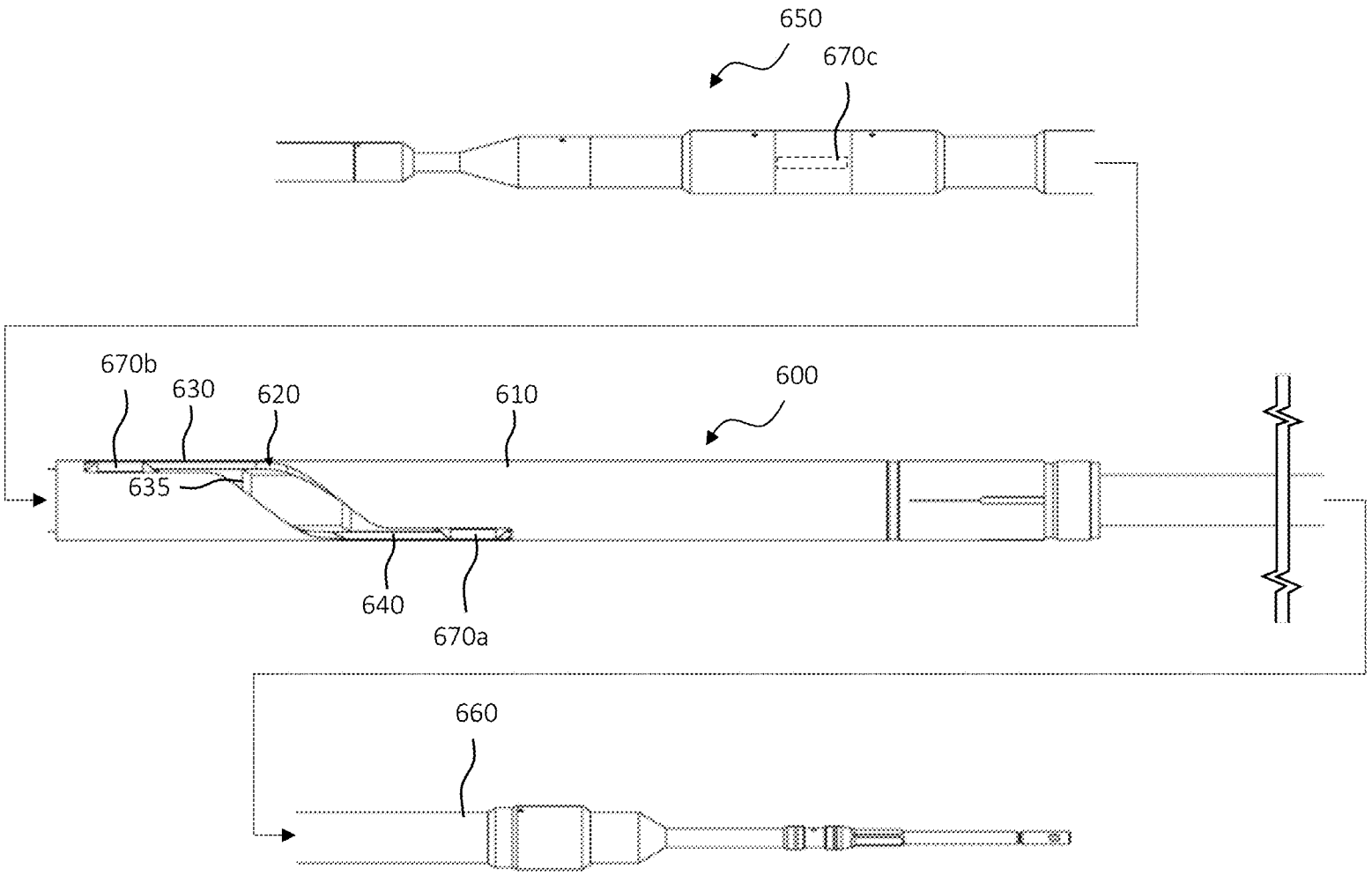

With reference to FIG. 6B, illustrated is the keyed running tool 650 of FIG. 6A after continuing to push the keyed running tool 650 downhole causing the downhole key 670*a* to rotate within the slot 620 until the downhole key 670*a* is positioned within the second axial portion 640 of the slot 620 and the middle key 670*b* is positioned within the first axial portion 630 of the slot 620. As the maximum distance ($d_m$) between the downhole key 670*a* and the middle key 670*b* is less than the length ($l_s$) of the slot 620, both of the downhole key 670*a* and the middle key 670*b* may be simultaneously located within the slot 620. Moreover, in certain embodiments, the relationship between the maximum distance ($d_m$) and the length ($l_s$) dictates that no more than two keys 670 may be engaged with the slot 620 at any one given moment in time. Furthermore, as the radial value for X is substantially similar to the radial value for Y, the downhole key 670*a* and the middle key 670*b* may be simultaneously located within second axial portion 640 and the first axial portion 630, respectively.

Figure 6C:
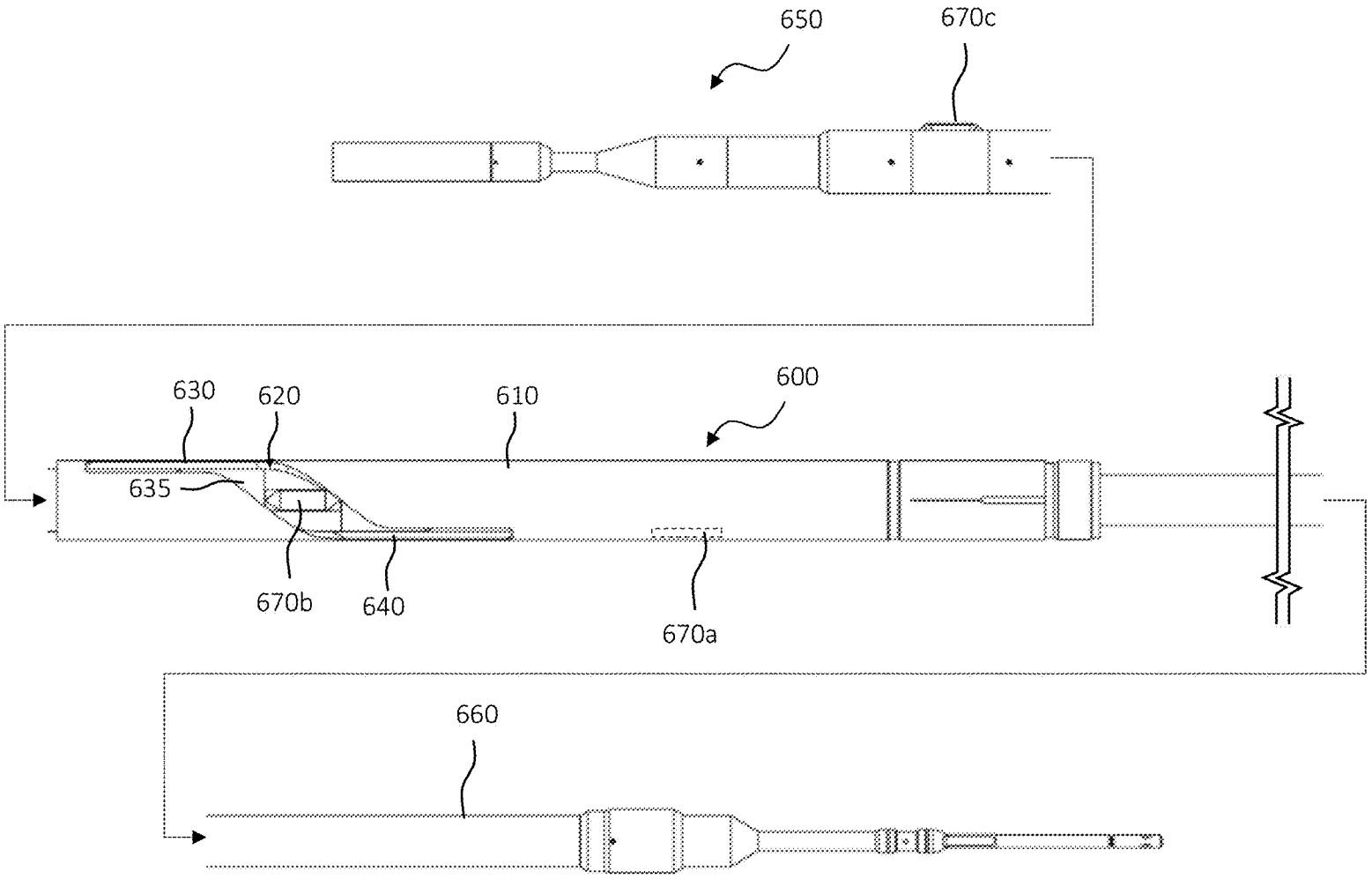

With reference to FIG. 6C, illustrated is the keyed running tool 650 of FIG. 6B after continuing to push the keyed running tool 650 downhole causing the downhole key 670*a* to move to its radially retracted state (e.g., within the tubular 610) and the middle key 670*b* to rotate to the angled portion 635 of the slot 620. Given the spacing between adjacent keys 670, in one or more embodiments, if one key (e.g., the middle key 670*b*) is located within the angled portion 635 of the slot 620, an adjacent key 670 (e.g., the downhole key 670*a* or the uphole key 670*c*) cannot also be located within the slot 620.

Figure 6D:
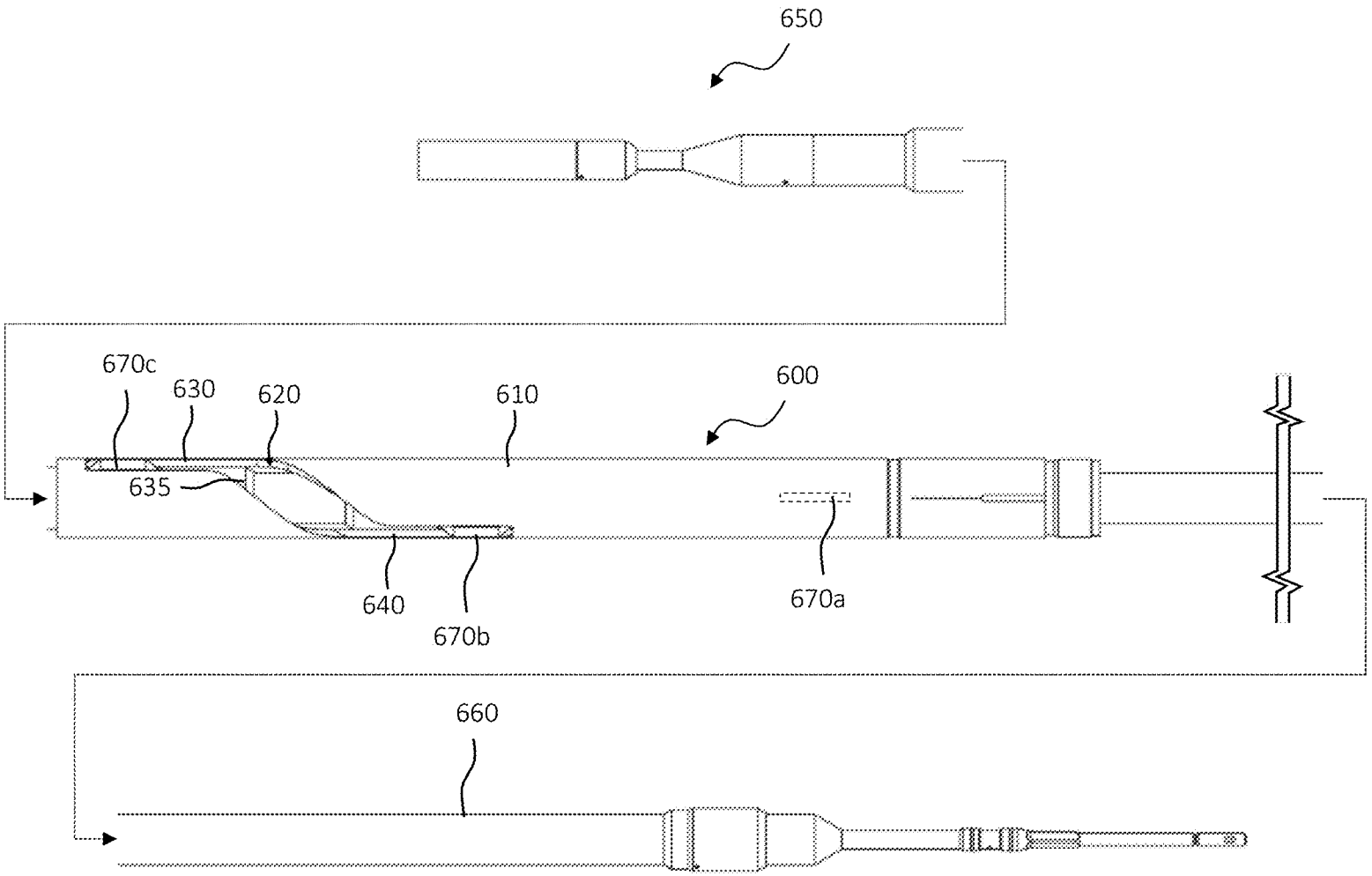

With reference to FIG. 6D, illustrated is the keyed running tool 650 of FIG. 6C after continuing to push the keyed running tool 650 downhole causing the middle key 670*b* to rotate within the slot 620 until the middle key 670*b* is positioned within the second axial portion 640 of the slot 620 and the uphole key 670*c* is positioned within the first axial portion 630 of the slot 620. As the maximum distance ($d_m$) between the middle key 670*b* and the uphole key 670*c* is less than the length ($l_s$) of the slot 620, both of the middle key 670*b* and the uphole key 670*c* may be simultaneously located within the slot 620. Furthermore, as the radial value for X is substantially similar to the radial value for Y, the middle key 670*b* and the uphole key 670*c* may be simultaneously located within second axial portion 640 and the first axial portion 630, respectively.

Figure 6E:
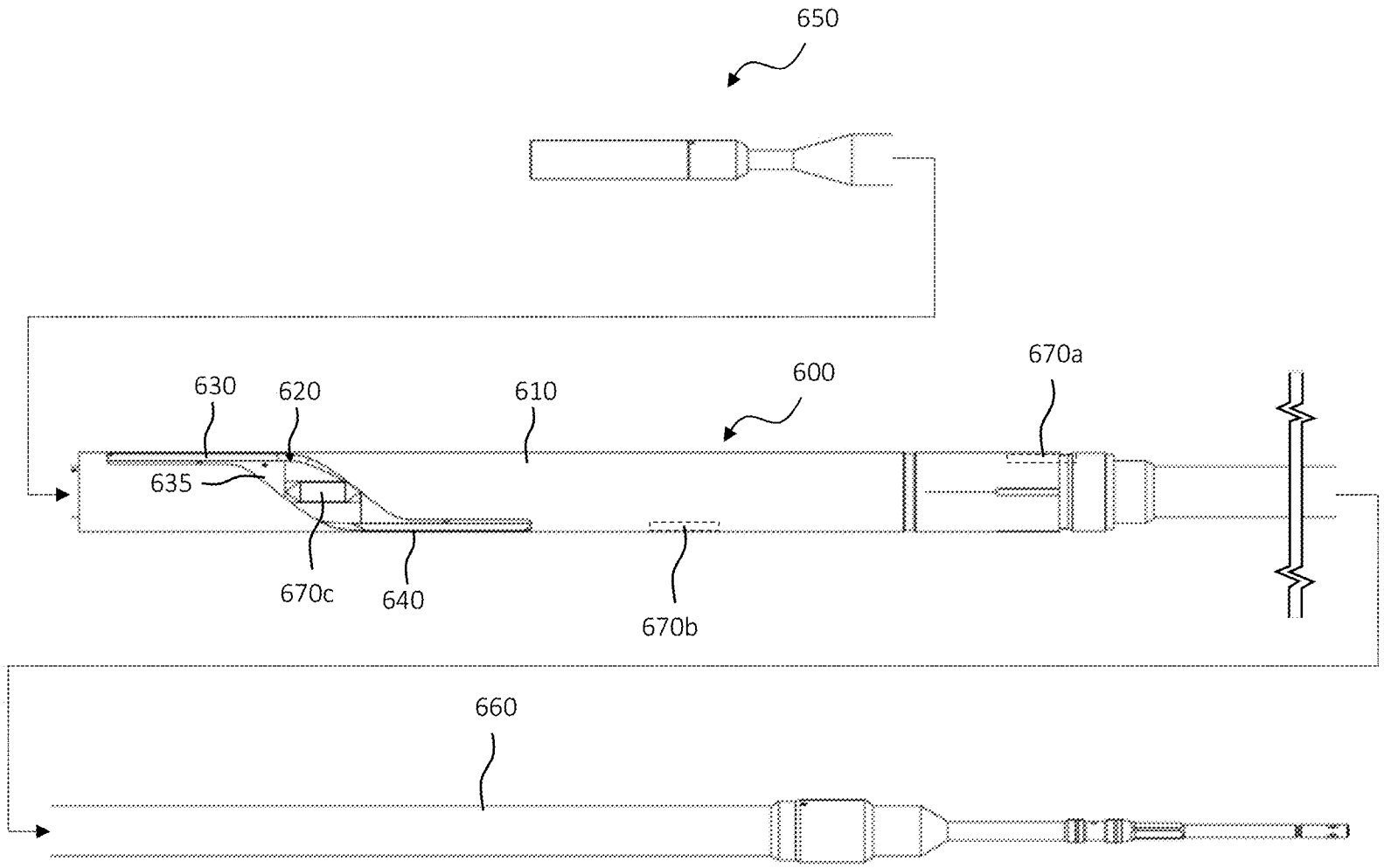

With reference to FIG. 6E, illustrated is the keyed running tool 650 of FIG. 6D after continuing to push the keyed running tool 650 downhole causing the middle key 670*b* to also move to its radially retracted state (e.g., within the tubular 610) and the uphole key 670*c* to rotate to the angled portion 635 of the slot 620. Given the spacing between adjacent keys 670, in one or more embodiments, if one key (e.g., the uphole key 670*c*) is located within the angled portion 635 of the slot 620, adjacent key 670 (e.g., the downhole key 670*a* or the middle key 670*b*) cannot also be located within the slot 620.

Figure 6F:
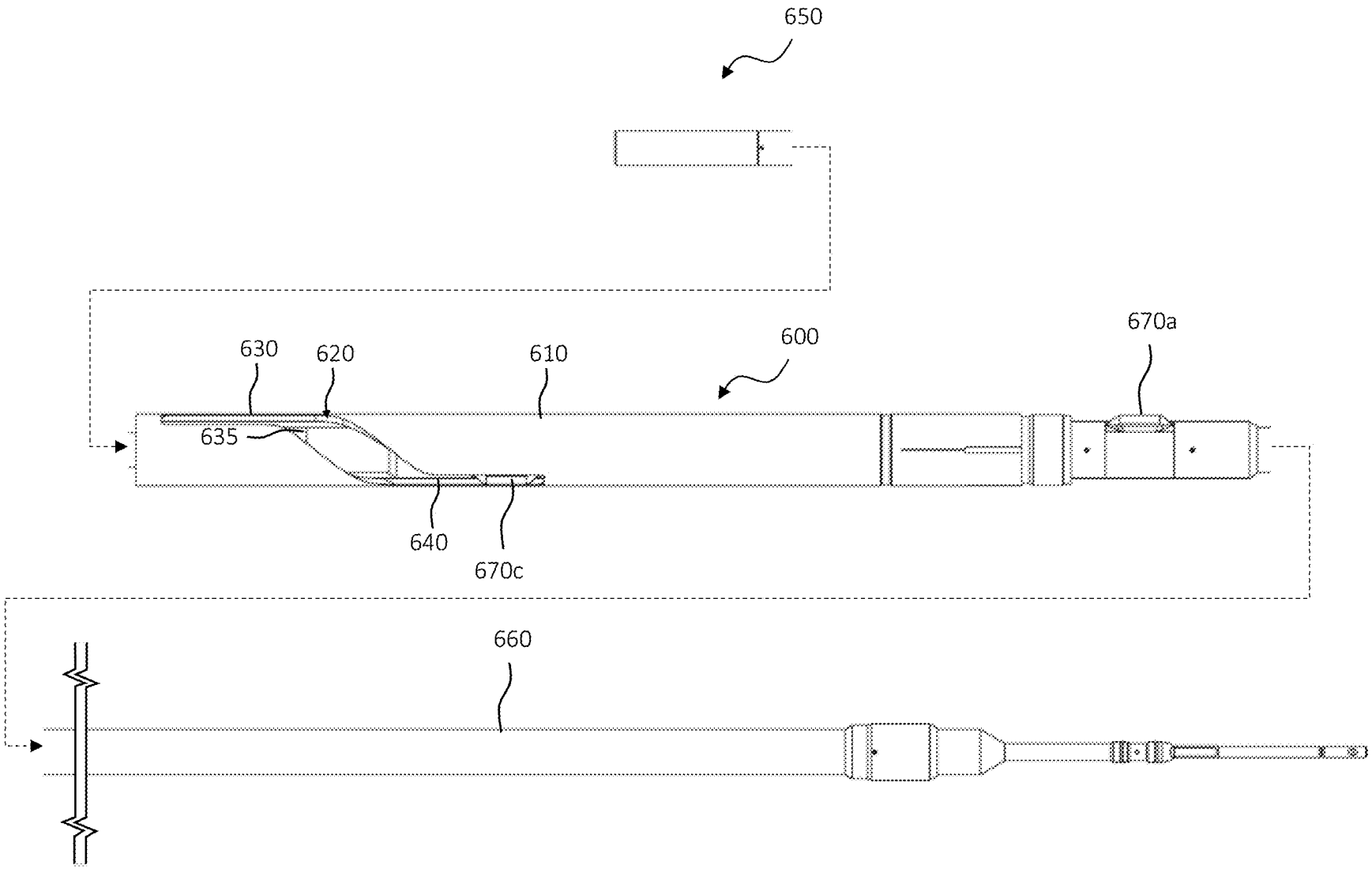

With reference to FIG. 6F, illustrated is the keyed running tool 650 of FIG. 6E after continuing to push the keyed running tool 650 downhole causing the uphole key 670*c* to rotate within the slot 620 until the uphole key 670*c* is positioned within the second axial portion 640 of the slot 620. At this stage, at least in the embodiment of FIGS. 6A through 6F, the keyed running tool 650 bottoms out, and thus cannot move any further downhole. Moreover, in certain embodiments, any downhole tool coupled to the keyed running tool 650 is rotationally, and laterally, placed at a desired position within the wellbore.

The embodiment of FIGS. 6A through 6F assume that the downhole key 670*a* is initially radially aligned with the slot 620 such that as the keyed running tool 650 is pushed downhole the downhole key 670*a* would engage with at least one of the first axial portion 630, the angled portion 635, or the second axial portion 640. Nevertheless, in certain instances the downhole key 670*a* would be radially misaligned with the slot 620 such that as the keyed running tool 650 is pushed downhole the downhole key 670*a* would not engage with the slot 620. In such an instance, either one of the middle key 670*b* or the uphole key 670*c* might initially radially align with the slot 620.

In the instance where the downhole key 670*a* is radially misaligned with the slot 620 but the middle key 670*b* is at least partially radially aligned with the slot 620, the keyed running tool 650 would be pushed downhole causing the downhole key 670*a* to miss the slot 620 and the middle key 670*b* to initially engage with and rotate within the slot 620 until the middle key 670*b* is positioned within the second axial portion 640 of the slot 620 and the uphole key 670*c* is positioned within the first axial portion 630 of the slot 620, very similar to that shown in FIGS. 6C and 6D. Thereafter, the process would proceed by continuing to push the keyed running tool 650 downhole causing the uphole key 670*c* to rotate within the slot 620 until the uphole key 670*c* is positioned within the second axial portion 640, at which time the downhole tool is rotationally positioned within the wellbore, very similar to that shown in FIGS. 6E and 6F.

In the instance where the downhole key 670*a* and the middle key 670*b* are both radially misaligned with the slot 620 but the uphole key 670*c* is at least partially radially aligned with the slot 620, the keyed running tool 650 would be pushed downhole causing the downhole key 670*a* and middle key 670*b* to miss the slot 620 and the uphole key 670*c* to initially engage with and rotate within the slot 620 until the uphole key 670*c* is positioned within the second axial portion 640, at which time the downhole tool is rotationally positioned within the wellbore, very similar to that shown in FIGS. 6E and 6F.

Unique to at least one embodiment of the design, no matter the radial alignment between the keyed running tool 650 and the slotted orientation apparatus 600, at least one of the downhole key 670*a*, the middle key 670*b*, or the uphole key 670*c* will at least partially align with the slot 620. Accordingly, regardless of the radial alignment, in at least one embodiment the uphole key 670*c* will ultimately always end up in the second axial portion 640, resulting in the downhole tool that is coupled to a downhole end of the keyed running tool 650 being both laterally and rotationally positioned as a desired located within the wellbore.

It should be apparent to one skilled in the art that the keyed running tool 650 may also align with respect to the slotted orientation apparatus 600 when traveling from below the slotted orientation apparatus 600 in an upward motion (e.g., provided the keys 670*a*, 670*b* and 670*c* have the proper profile to engage the slot 620 in the slotted orientation apparatus 600. For example, the keys 670*a*, 670*b* and 670*c* could engage with the slot 620 in the opposite manner as was described above with respect to FIGS. 6A through 6F.

It should also be noted that the slotted orientation apparatus 600 may have an upward no-go to hold the keyed running tool 650 in an axial position until a desired amount of upward force is exerted to cause the no-go mechanism (not shown) to allow further upwardly movement. In some embodiments, one or more of the keys (e.g., uphole key 670*c*) may provide the desired resistance to temporarily halt the upward movement of the keyed running tool 650 (e.g., until additional force is applied).

It should also be noted that the slotted orientation apparatus 600 may be designed to slide/fit inside a standard API-type casing, or a specially designed tubular with an OD similar (or different) than a standard API casing, tubing, or other tubular.

It should be noted that the lengths of the first and second axial portions 630, 640 do not have to be the same. In some examples it may be desirable for the keyed running tool 650 to be held at a certain orientation by one or more of the keys 670 until an additional distance has been traveled—or a certain event has occurred (e.g., mating up with another assembly pre-installed in the well).

It should be apparent that the slotted orientation apparatus (e.g., slotted orientation apparatus 300, 600) and the keyed running tool (e.g., keyed running tool 500, 650) disclosed herein may be used to perform other actions whether or not debris may be an issue. For example, the slotted orientation apparatus may be used to orient tools for formation evaluation, production evaluation, evaluating the condition of tools/equipment, etc. In at least one embodiment, the slotted orientation apparatus could orient a feeler gauge (e.g., multi-finger device) to measure erosion at various orientations.

A keyed running tool according to the disclosure may be a sleeve-type device, wherein after it orients a tool it remains located in the slotted orientation apparatus while the oriented tool (and coiled tubing) continues to move downward. For example, the sleeve-type keyed running tool might orient the tool so it enters the mainbore leg of a multilateral junction. After the oriented tool is aligned, the sleeve-type keyed running tool might release itself from the tubing (e.g., coiled tubing), so the oriented tool can continue to be lowered into the mainbore via the tubing. In at least one other embodiment, the sleeve-type keyed running tool could have a jay-profile, so that when the other tool is pulled back above a y-block, the sleeve-type keyed running will index 90-degrees and the other tool will enter the lateral bore of the multilateral junction and/or y-block.

Aspects disclosed herein include:

A. A slotted orientation apparatus for use with a keyed running tool, the slotted orientation apparatus including: 1) a tubular having a wall thickness (t); and 2) a slot extending at least partially through the tubular, the slot having an angled portion coupled to an axial portion, wherein the slot radially extends around the tubular X degrees, wherein X is 180 degrees or less.

B. A well system, the well system including: 1) a wellbore located within a subterranean formation; and 2) a slotted orientation apparatus positioned within the wellbore, the slotted orientation apparatus including: a) a tubular having a wall thickness (t); and b) a slot extending at least partially through the tubular, the slot having an angled portion coupled to an axial portion, wherein the slot radially extends around the tubular X degrees, wherein X is 180 degrees or less.

C. A method for aligning a downhole tool, the method including: 1) positioning a slotted orientation apparatus within a wellbore in a subterranean formation, the slotted orientation apparatus including: a) a tubular having a wall thickness (t); and b) a slot extending at least partially through the tubular, the slot having an angled portion coupled to an axial portion, wherein the slot radially extends around the tubular X degrees, wherein X is 180 degrees or less; and 2) positioning a keyed running tool having a downhole tool coupled to a downhole end thereof at least partially within the slotted orientation apparatus, the keyed running tool having two or more keys, at least one of the two or more keys engaging with the slot to rotationally position the downhole tool within the wellbore.

D. A keyed running tool for use with a slotted orientation apparatus, the keyed running tool including: 1) a housing; and 2) two or more keys extending from the housing, the two or more keys movable between a radially retracted state and a radially extended state, wherein adjacent ones of the two or more keys are laterally offset from each other and radially offset from each other by Y degrees, wherein Y is 180 degrees or less.

E. A well system, the well system including: 1) a slotted orientation apparatus positioned within a wellbore located in a subterranean formation, the slotted orientation apparatus including: a) a tubular having a wall thickness (t); and b) a slot extending at least partially through the tubular, the slot having first and second axial portions laterally offset from one another by a distance ($d_s$), and an angled portion connecting the first and second axial portions; and 2) a keyed running tool having a downhole tool coupled to a downhole end therein positioned within the slotted orientation apparatus, the keyed running tool including: a) a housing; and b) two or more keys extending from the housing, the two or more keys movable between a radially retracted state and a radially extended state, wherein adjacent ones of the two or more keys are laterally offset from each other and radially offset from each other by Y degrees, wherein Y is 180 degrees or less.

F. A method for aligning a downhole tool, the method including: 1) positioning a slotted orientation apparatus within a wellbore located in a subterranean formation, the slotted orientation apparatus including: a) a tubular having a wall thickness (t); and b) a slot extending at least partially through the tubular, the slot having first and second axial portions laterally offset from one another by a distance ($d_s$), and an angled portion connecting the first and second axial portions; and 2) positioning a keyed running tool having a downhole tool coupled to a downhole end thereof at least partially within the slotted orientation apparatus, the keyed running tool including: a) a housing; and b) two or more keys extending from the housing, the two or more keys movable between a radially retracted state and a radially extended state, wherein adjacent ones of the two or more keys are laterally offset from each other and radially offset from each other by Y degrees, wherein Y is 120 degrees or less.

Aspects A, B, C, D, E, and F may have one or more of the following additional elements in combination: Element 1: wherein X is less than 180 degrees. Element 2: wherein X is 120 degrees or less. Element 3: wherein X is 90 degrees or less. Element 4: wherein the tubular has a length (l) ranging from 5 cm to 18.5 m. Element 5: wherein the slot has a length ($l_s$) ranging from 2.5 cm to 900 cm. Element 6: wherein the slot has first and second axial portions laterally offset from one another by a distance ($d_s$), the angled portion connecting the first and second axial portions. Element 7: wherein each of the first and second axial portions have a length ($l_{ap}$) ranging from 1 cm to 600 cm. Element 8: wherein the distance ($d_s$) ranges from 1 cm to 900 cm. Element 9: wherein an angle ($\theta$) of the angled portion ranges from 15 degrees to 60 degrees. Element 10: wherein the slot has first and second axial portions laterally offset from one another by a distance ($d_s$), the angled portion connecting the first and second axial portions. Element 11: wherein the slot is located on a high side of the tubular such that no portion of the slot is located below 3 o'clock or below 9 o'clock relative to gravity. Element 12: wherein a radial centerpoint of the slot is positioned at 12 o'clock relative to gravity, and further wherein X is less than twice a complementary angle of repose of a material in the tubular. Element 13: wherein the angle of repose of the material is at least 15 degrees, and X is less than 150 degrees. Element 14: wherein the angle of repose of the material is at least 30 degrees, and the X is less than 120 degrees. Element 15: wherein the angle of repose of the material is at least 40 degrees, and the X is less than 100 degrees. Element 16: further including a keyed running tool positioned within the wellbore and located within the slotted orientation apparatus, the keyed running tool having two or more keys, adjacent ones of the two or more keys laterally offset by a maximum distance ($d_m$). Element 17: wherein the adjacent ones of the two or more keys are radially offset from each other by Y degrees, wherein Y is substantially equal to X. Element 18: wherein the slot has a length ($l_s$), and further wherein the maximum distance ($d_m$) is less than the length ($l_s$). Element 19: wherein the slotted orientation apparatus forms at least a portion of a multilateral junction, the multilateral junction further including a tubular spacer positioned downhole of the slotted orientation apparatus, a whipstock positioned downhole of the tubular spacer, a y-block positioned downhole of the whipstock, and a main bore leg and a lateral bore leg coupled to a downhole end of the y-block. Element 20: further including an orientation tool coupled to the slotted orientation apparatus, the orientation tool configured to orient the slot of the slotted orientation apparatus within the wellbore. Element 21: wherein the orientation tool is a measuring while drilling tool that uses pressure pulses to orient the slot of the slotted orientation apparatus within the wellbore. Element 22: wherein positioning the slotted orientation apparatus includes positioning the slotted orientation apparatus with the slot located on a high side of the tubular such that no portion of the slot is located below 3 o'clock or below 9 o'clock relative to gravity. Element 23: wherein the slot has first and second axial portions laterally offset from one another by a distance ($d_s$), the angled portion connecting the first and second axial portions. Element 24: wherein the two or more keys are radially offset from each other by Y degrees, wherein Y is substantially equal to X. Element 25: wherein the keyed running tool includes three keys, and further wherein Y is equal to 120 degrees. Element 26: wherein positioning the keyed running tool includes: pushing the keyed running tool downhole causing a downhole one of the three keys to initially engage with and rotate within the slot until the downhole one of the three keys is positioned within the second axial portion of the slot and a middle one of the three keys is positioned within the first axial portion of the slot; then continuing to push the keyed running tool downhole causing the middle one of the three keys to rotate within the slot until the middle one of the three keys is positioned within the second axial portion of the slot and an uphole one of the three keys is positioned within the first axial portion of the slot; and then continuing to push the keyed running tool downhole causing the uphole one of the three keys to rotate within the slot until the uphole one of the three keys is positioned within the second axial portion, at which time the downhole tool is rotationally positioned within the wellbore. Element 27: wherein positioning the keyed running tool includes: pushing the keyed running tool downhole causing a downhole one of the of the three keys to miss the slot and a middle one of the three keys to initially engage with and rotate within the slot until the middle one of the three keys is positioned within the second axial portion of the slot and an uphole one of the three keys is positioned within the first axial portion of the slot; and then continuing to push the keyed running tool downhole causing the uphole one of the three keys to rotate within the slot until the uphole one of the three keys is positioned within the second axial portion, at which time the downhole tool is rotationally positioned within the wellbore. Element 28: wherein positioning the keyed running tool includes: pushing the keyed running tool downhole causing a downhole one and a middle one of the three keys to miss the slot and an uphole one of the three keys to initially engage with and rotate within the slot until the uphole one of the three keys is positioned within the second axial portion of the slot, at which time the downhole tool is rotationally positioned within the wellbore. Element 29: wherein the slot has a length ($l_s$) and adjacent ones of the two or more keys are laterally offset by a maximum distance ($d_m$), and further wherein the maximum distance ($d_m$) is less than the length ($l_s$). Element 30: wherein the slotted orientation apparatus forms at least a portion of a multilateral junction, the multilateral junction further including a tubular spacer positioned downhole of the slotted orientation apparatus, a whipstock positioned downhole of the tubular spacer, a y-block positioned downhole of the whipstock, and a main bore leg and a lateral bore leg coupled to a downhole end of the y-block. Element 31: wherein Y is less than 180 degrees. Element 32: wherein Y is 120 degrees or less. Element 33: wherein Y is 90 degrees or less. Element 34: wherein adjacent ones of the two or more keys are laterally offset from each other by a maximum distance ($d_m$) ranging from 2.5 cm to 900 cm. Element 35: wherein three keys extend from the housing, adjacent ones of the three keys radially offset from each other by the Y degrees, wherein Y is equal to 120 degrees. Element 36: wherein an odd number of keys extend from the housing. Element 37: wherein the two or more keys are two or more spring loaded keys. Element 38: further including a swivel coupled to an uphole end of the housing, the swivel configured to allow the housing and the two or more keys to rotate when following a slot in a slotted orientation apparatus. Element 39: further including an engagement member coupled to a downhole end of the housing, the engagement member configured to engage with a downhole tool and rotationally position the downhole tool within a wellbore it is located within. Element 40: wherein the downhole tool is a whipstock. Element 41: wherein at least one of the two or more keys is engaged with the slot. Element 42: wherein two of the two or more keys are engaged with the slot. Element 43: wherein no more than two of the two or more keys are engaged with the slot. Element 44: wherein the slot radially extends around the tubular X degrees, wherein Y is substantially equal to X. Element 45: wherein Y is less than 180 degrees. Element 46: wherein Y is 120 degrees or less. Element 47: wherein the slot has a length ($l_s$) and adjacent ones of the two or more keys are laterally offset by a maximum distance ($d_m$), and further wherein the maximum distance ($d_m$) is less than the length ($l_s$). Element 48: wherein three keys extend from the housing, adjacent ones of the three keys radially offset from each other by the Y degrees, wherein Y is 120 degrees. Element 49: further including a swivel coupled to an uphole end of the housing, the swivel configured to allow the housing and the two or more keys to rotate when following the slot. Element 50: further including an engagement member coupled to a downhole end of the housing, the engagement member configured to engage with the downhole tool and rotationally position the downhole tool within the wellbore. Element 51: wherein the downhole tool is a whipstock. Element 52: wherein the keyed running tool includes three keys radially offset from each other by the Y degrees, wherein Y is 120 degrees, and further wherein positioning the keyed running tool includes: pushing the keyed running tool downhole causing a downhole one of the three keys to initially engage with and rotate within the slot until the downhole one of the three keys is positioned within the second axial portion of the slot and a middle one of the three keys is positioned within the first axial portion of the slot; then continuing to push the keyed running tool downhole causing the middle one of the three keys to rotate within the slot until the middle one of the three keys is positioned within the second axial portion of the slot and an uphole one of the three keys is positioned within the first axial portion of the slot; and then continuing to push the keyed running tool downhole causing the uphole one of the three keys to rotate within the slot until the uphole one of the three keys is positioned within the second axial portion, at which time the downhole tool is rotationally positioned within the wellbore. Element 53: wherein the keyed running tool includes three keys radially offset from each other by the Y degrees, wherein Y is 120 degrees, and further wherein positioning the keyed running tool includes: pushing the keyed running tool downhole causing a downhole one of the of the three keys to miss the slot and a middle one of the three keys to initially engage with and rotate within the slot until the middle one of the three keys is positioned within the second axial portion of the slot and an uphole one of the three keys is positioned within the first axial portion of the slot; and then continuing to push the keyed running tool downhole causing the uphole one of the three keys to rotate within the slot until the uphole one of the three keys is positioned within the second axial portion, at which time the downhole tool is rotationally positioned within the wellbore. Element 54: wherein the keyed running tool includes three keys radially offset from each other by the Y degrees, wherein Y is 120 degrees, and further wherein positioning the keyed running tool includes: pushing the keyed running tool downhole causing a downhole one and a middle one of the three keys to miss the slot and an uphole one of the three keys to initially engage with and rotate within the slot until the uphole one of the three keys is positioned within the second axial portion of the slot, at which time the downhole tool is rotationally positioned within the wellbore.

Those skilled in the art to which this application relates will appreciate that other and further additions, deletions, substitutions and modifications may be made to the described embodiments.

What is claimed is:

1. A keyed running tool for use with a slotted orientation apparatus, comprising:

a housing;

two or more keys extending from the housing, the two or more keys including a single first key extending from the housing at a first lateral location, the single first key movable between a first radially retracted state and a first radially extended state and a single second key extending from the housing at a second different lateral location, the single second key movable between a second radially retracted state and a second radially extended state, wherein the single first key and the single second key are radially offset from each other by Y degrees, wherein Y is 180 degrees or less, wherein no keys of the two or more keys extending from the housing are rotationally aligned.

2. The keyed running tool as recited in claim 1, wherein Y is less than 180 degrees.

3. The keyed running tool as recited in claim 1, wherein Y is 120 degrees or less.

4. The keyed running tool as recited in claim 1, wherein Y is 90 degrees or less.

5. The keyed running tool as recited in claim 1, wherein adjacent ones of the two or more keys are laterally offset from each other by a maximum distance ($d_m$) ranging from 2.5 cm to 900 cm.

6. The keyed running tool as recited in claim 1, wherein the two or more keys further includes a single third key extending from the housing at a third different lateral location, wherein the single first, single second and single third keys are radially offset from each other by the Y degrees, wherein Y is equal to 120 degrees.

7. The keyed running tool as recited in claim 1, wherein the two or more keys is an odd number of keys extend from the housing.

8. The keyed running tool as recited in claim 1, wherein the two or more keys are two or more spring loaded keys.

9. The keyed running tool as recited in claim 1, further including a swivel coupled to an uphole end of the housing, the swivel configured to allow the housing and the two or more keys to rotate when following a slot in a slotted orientation apparatus.

10. The keyed running tool as recited in claim 1, further including an engagement member coupled to a downhole end of the housing, the engagement member configured to engage with a downhole tool and rotationally position the downhole tool within a wellbore it is located within.

11. The keyed running tool as recited in claim 10, wherein the downhole tool is a whipstock.

12. A well system, comprising:

a slotted orientation apparatus positioned within a wellbore located in a subterranean formation, the slotted orientation apparatus including:

a tubular having a wall thickness (t); and a slot extending at least partially through the tubular, the slot having first and second axial portions laterally offset from one another by a distance ($d_s$), and an angled portion connecting the first and second axial portions; and a keyed running tool having a downhole tool coupled to a downhole end therein positioned within the slotted orientation apparatus, the keyed running tool including: a housing; and two or more keys extending from the housing, the two or more keys including a single first key extending from the housing at a first lateral location, the single first key movable between a first radially retracted state and a radially extended state and a single second key extending from the housing at a second different lateral location, the single second key movable between a second radially retracted state and a second radially extended state, wherein the single first key and the single second key are radially offset from each other by Y degrees, wherein Y is 180 degrees or less, wherein no keys of the two or more keys extending from the housing are rotationally aligned.

13. The well system as recited in claim 12, wherein at least one of the single first key or the single second key is engaged with the slot.

14. The well system as recited in claim 12, wherein both of the single first key and the single second key are engaged with the slot.

15. The well system as recited in claim 14, wherein no more than two of the two or more keys are engaged with the slot.

16. The well system as recited in claim 12, wherein the slot radially extends around the tubular X degrees, wherein Y is substantially equal to X.

17. The well system as recited in claim 12, wherein Y is less than 180 degrees.

18. The well system as recited in claim 12, wherein Y is 120 degrees or less.

19. The well system as recited in claim 12, wherein the slot has a length ($l_s$) and adjacent ones of the two or more keys are laterally offset by a maximum distance ($d_m$), and further wherein the maximum distance ($d_m$) is less than the length ($l_s$).

20. The well system as recited in claim 12, wherein three keys extend from the housing, adjacent ones of the three keys radially offset from each other by the Y degrees, wherein Y is 120 degrees.

21. The well system as recited in claim 12, further including a swivel coupled to an uphole end of the housing, the swivel configured to allow the housing and the two or more keys to rotate when following the slot.

22. The well system as recited in claim 12, further including an engagement member coupled to a downhole end of the housing, the engagement member configured to engage with the downhole tool and rotationally position the downhole tool within the wellbore.

23. The well system as recited in claim 22, wherein the downhole tool is a whipstock.

24. A method for aligning a downhole tool, comprising:

positioning a slotted orientation apparatus within a wellbore located in a subterranean formation, the slotted orientation apparatus including:

a tubular having a wall thickness (t); and a slot extending at least partially through the tubular, the slot having first and second axial portions laterally offset from one another by a distance ($d_s$), and an angled portion connecting the first and second axial portions; and positioning a keyed running tool having a downhole tool coupled to a downhole end thereof at least partially within the slotted orientation apparatus, the keyed running tool including:

a housing;

and two or more keys extending from the housing, the two or more keys including a single first key extending from the housing at a first lateral location, the single first key movable between a first radially retracted state and a first radially extended state and a single second key extending from the housing at a second different lateral location, the single second key movable between a second radially retracted state and a second radially extended state, wherein the single first key and the single second key are radially offset from each other by Y degrees, wherein Y is 180 degrees or less, wherein no keys of the two or more keys extending from the housing are rotationally aligned.

25. The method as recited in claim 24, wherein the two or more keys further includes a single third key extending from the housing at a third different lateral location, wherein the single first, single second and single third keys are radially offset from each other by the Y degrees, wherein Y is 120 degrees, and further wherein positioning the keyed running tool includes:

pushing the keyed running tool downhole causing a downhole one of the single first, single second and single third keys to initially engage with and rotate within the slot until the downhole one of the single first, single second and single third keys is positioned within the second axial portion of the slot and a middle one of the single first, single second and single third keys is positioned within the first axial portion of the slot; then continuing to push the keyed running tool downhole causing the middle one of the single first, single second and single third keys to rotate within the slot until the middle one of the single first, single second and single third keys is positioned within the second axial portion of the slot and an uphole one of the single first, single second and single third keys is positioned within the first axial portion of the slot; and then continuing to push the keyed running tool downhole causing the uphole one of the single first, single second and single third keys to rotate within the slot until the uphole one of the single first, single second and single third keys is positioned within the second axial portion, at which time the downhole tool is rotationally positioned within the wellbore.

26. The method as recited in claim 24, wherein the two or more keys further includes a single third key extending from the housing at a third different lateral location, wherein the single first, single second and single third keys are radially offset from each other by the Y degrees, wherein Y is 120 degrees, and further wherein positioning the keyed running tool includes:

pushing the keyed running tool downhole causing a downhole one of the of the single first, single second and single third keys to miss the slot and a middle one of the single first, single second and single third keys to initially engage with and rotate within the slot until the middle one of the single first, single second and single third keys is positioned within the second axial portion of the slot and an uphole one of the single first, single second and single third keys is positioned within the first axial portion of the slot; and then continuing to push the keyed running tool downhole causing the uphole one of the single first, single second and single third keys to rotate within the slot until the uphole one of the single first, single second and single third keys is positioned within the second axial portion, at which time the downhole tool is rotationally positioned within the wellbore.

27. The method as recited in claim 24, wherein the two or more keys further includes a single third key extending from the housing at a third different lateral location, wherein the single first, single second and single third keys are radially offset from each other by the Y degrees, wherein Y is 120 degrees, and further wherein positioning the keyed running tool includes:

pushing the keyed running tool downhole causing a downhole one and a middle one of the single first, single second and single third keys to miss the slot and an uphole one of the single first, single second and single third keys to initially engage with and rotate within the slot until the uphole one of the single first, single second and single third keys is positioned within the second axial portion of the slot, at which time the downhole tool is rotationally positioned within the wellbore.

* * * * *